United States Patent [19]

Clark

[11] 3,979,311

[45] Sept. 7, 1976

[54] CORROSION INHIBITOR COMPOSITIONS

[75] Inventor: Herbert D. Clark, Burbank, Calif.

[73] Assignee: Universal Oil Products Company, Des Plaines, Ill.

[22] Filed: May 30, 1974

[21] Appl. No.: 474,568

[52] U.S. Cl. ..... 252/82; 252/87; 252/149; 252/391

[51] Int. Cl.[2] ..... C23F 11/04; C23G 1/06

[58] Field of Search ..... 252/391, 8.55 C, 8.55 E, 252/149, 146, 82, 87

[56] References Cited

UNITED STATES PATENTS

| | | | |
|---|---|---|---|
| 2,071,966 | 2/1937 | Bolton | 252/149 |
| 2,799,649 | 7/1957 | Caldwell et al. | 252/8.55 |
| 2,913,408 | 11/1959 | Pumpelly et al. | 252/8.55 |
| 2,993,864 | 7/1961 | Monroe et al. | 252/8.55 X |
| 3,107,221 | 10/1963 | Harrison et al. | 252/8.55 X |
| 3,404,094 | 10/1968 | Keeney | 252/8.55 X |
| 3,619,125 | 11/1971 | Porwancher et al. | 252/391 X |
| 3,669,902 | 6/1972 | Hirner | 252/391 |
| 3,779,935 | 12/1973 | McDougall et al. | 252/391 X |

*Primary Examiner*—Herbert B. Guynn
*Attorney, Agent, or Firm*—James R. Hoatson, Jr.; Raymond H. Nelson; William H. Page II

[57] ABSTRACT

A synergistic mixture of an alkynyl cycloalkanol and an N,N'-dicycloalkyl-thiourea is used as an inhibitor in protecting metals from acid attack when cleaning said metals with an acid solution.

4 Claims, No Drawings

CORROSION INHIBITOR COMPOSITIONS

BACKGROUND OF THE INVENTION

Metals which are used to form recirculating water systems, steam boilers and other related equipment are subject to the formation of scale which are water formed deposits. An example of the scale which is formed on the inner surfaces of these systems would be the calcium carbonate scale which builds up during the use of this equipment. One method of removing scale deposits from metal surfaces consists of treating the metal with a hydrochloric acid solution. However, during this acid cleaning procedure, extreme care must be observed in order to protect the metal against being eaten away or eroded by the acid. In addition to the descaling operation, similar precautions must be exercised in other acid cleaning operations or in acid pickling operations whereby the metal must be protected against excessive destruction by the acid during the cleaning steps.

This invention relates to novel inhibitor compositions which are added to an acid solution and serves to protect the metal when the acid solution is used in a metal cleaning operation. More particularly, the invention is concerned with a synergistic mixture of compounds whereby the metal which is being treated will be protected to a greater extent by use thereof than will be protected when utilizing one or the other of the components of the synergistic mixture.

As hereinbefore set forth, it is imperative that metal utilized in various cooling systems, steam boilers, etc., must be protected when being treated with an acid solution in a descaling or cleaning operation. A particular application in which the novel synergistic inhibitor mixture of the present invention may be used is the removal of scale deposits in boilers which are used to generate steam or in cooling water systems or other operations in which scale deposits are formed by the polyvalent ions which are contained in the water. The deposits which form the scale usually comprise salts such as calcium sulfate, calcium carbonate, the corresponding barium salts, etc. Heretofore various metal protecting inhibitors have been added to the acid solutions to protect the metals from acid attack. As will hereinafter be shown in greater detail, it has now been unexpectedly discovered that a novel synergistic mixture may be prepared which will protect the metal from acid attack to a much greater degree than would heretofore have been expected.

It is therefore an object of this invention to provide a novel inhibitor composition.

A further object of this invention is to provide a novel synergistic mixture which acts as an inhibitor and prevents the attack of metals from an acid solution which it utilized in a cleaning operation.

In one aspect an embodiment of this invention resides in a synergistic mixture of from about 50% to about 70% by weight of an alkynyl cycloalkanol and from about 50 to about 30% by weight of an N,N'-dicycloalkyl-thiourea.

A specific embodiment of this invention resides in a synergistic mixture of from about 50 to about 70% by weight of ethynyl cyclohexanol and from about 50 % to about 30% by weight of N,N'-dicyclohexyl-thiourea which is prepared as a composition containing from about 5 to about 20% by weight of N,N'-dicyclohexyl-thiourea, from about 40 to about 80% by weight of N,N'-dimethylacetamide and from about 5 to about 30% by weight of polyoxyethylene or polyoxypropylene derivatives.

Another specific embodiment of this invention relates to a method for removing scale in boilers which are used to generate steam from water which comprises treating the metal surface of the boiler with an acid solution containing asynergistic mixture of from about 50 to about 70% by weight of an alkynyl cycloalkanol and from about 50 to about 30% by weight of an N,N'-dicycloalkyl-thiourea.

Other objects and embodiments will be found in the following further detailed description of the present invention.

As hereinbefore set forth the present invention is concerned with a novel synergistic mixture of compounds which act as inhibitors in protecting metals from acid attack when the metals are subjected to a cleansing operation to remove water formed deposits from the surface thereof. One component of the novel inhibitor composition of matter of the present invention comprises an N,N'-dicycloalkyl-thiourea. The dicycloalkyl derivatives may contain from 3 to about 12 carbon atoms in the cycloalkyl ring, the preferred compound comprising N,N'-dicyclohexyl-thiourea. The aforementioned N,N'-dicycloalkyl-thiourea preferably is utilized as a 5 to 25% by weight solution or suspension in a water soluble solvent, emulsifier, dispersant, or the like.

Any suitable water soluble solvent, emulsifier, dispersant or the like may be used and may be selected from one or more of the following: (1) alcohols including methanol, ethanol, propanol, butanol, etc., (2) glycols including ethylene glycol, diethylene glycol, propylene glycol, dipropylene glycol, dimethylethylene glycol, trimethyldiethylene glycol and higher molecular weight polyethylene glycols or polypropylene glycols, (3) ketones including acetone, methyl ethyl ketone, diethyl ketone, methyl propyl ketone, ethyl propyl ketone, dipropyl ketone, etc., (4) polyoxyethylene ether, polyoxypropylene ether, methoxy polyethylene glycol. etc., (5) dimethylformamide, dimethylacetamide, diethylacetamide, dipropylacetamide, dimethylpropionamide, diethylpropionamide, etc., or (6) mixtures thereof. A particularly preferred mixture used with the dicyclohexyl-thiourea is from about 5 to about 20% dicyclohexyl-thiourea, from about 40 to about 80% by weight of N,N-dimethylacetamide and from about 5 to about 30% by weight of polyoxyethylene and/or polyoxypropylene derivative. The polyethylene glycols preferably have a molecular weight of from about 150 to about 1000 and more particularly from about 180 to about 800. The particular compound or compounds which are used will be selected with reference to the particular mixture of alkynyl cycloalkanol and dicycloalkyl-thiourea as well as the particular acid which is employed and the particular type of metal surface which is to be subjected to a cleansing operation. The combination of the dicycloalkyl-thiourea and the alkynyl cycloalkanol of the type hereinafter set forth in greater detail on an active ingredient basis may be in a concentration of from about 5 to about 95% by weight and preferably from about 8 to about 60% by weight.

The alkynyl cycloalkanols which comprise the other active component of the synergistic inhibitor composition of the present invention comprise those in which the alkynyl portion of the molecule will contain from 2 to about 5 carbon atoms in length. Some specific examples of these compounds will include ethynyl cyclopropanol, ethynyl cyclobutanol, ethynyl cyclopentanol, ethynyl cyclohexanol, ethynyl cycloheptanol, ethynyl cyclooctanol, propynyl cyclopropanol, propynyl cyclobutanol, propynyl cyclopentanol, propynyl cyclohexanol, propynyl cycloheptanol, propynyl cyclooctanol, butynyl cyclopropanol, butynyl cyclobutanol, butynyl cyclopentanol, butynyl cyclohexanol, butynyl cycloheptanol, butynyl cyclooctanol, pentynyl cyclopropanol, pentynyl cyclobutanol, pentynyl cyclopentanol, pentynyl cyclohexanol, pentynyl cycloheptanol, pentynyl cyclooctanol, etc., of the aforementioned alkynyl cycloalkanols the preferred compound being ethynyl cyclohexanol.

It is also contemplated within the scope of this invention that the inhibitor composition which will exhibit a synergistic effect in its ability to inhibit an acid attack on metals may contain a color indicator to permit visual observation of loss of potency of the inhibitor composition. For example, Methyl Violet may be included in the composition to indicate loss of potency when the color changes from violet to reddish. The amount of Methyl Violet will be sufficient for the purpose and may be used in an amount of from about 0.5 to about 10% by weight of the inhibitor composition, based on active ingredients, although lower or higher concentrations may be used as desired. It is understood that other suitable color indicators may be employed.

In a preferred method, the inhibitor mixture, with or without color indicator, is first prepared and then added to an aqueous solution of the acid. The specific amount of inhibitor composition to be included in the aqueous solution will be selected with reference to the particular use thereof. For example, when used for descaling, the inhibitor composition will be determined with regard to the amount and type of scale to be removed. The concentration of inhibitor composition may be within the range of from about 0.1 to about 1,000 and preferably from about 0.1 to about 100 ppm (parts per million) based on the acid, although lower or higher concentrations may be used as desired. The appended examples illustrate suitable solutions.

As hereinbefore set forth, in one application the mixture composition of the present invention which will exhibit a synergistic effect is used in acid solutions to remove scale formation in boilers. The scale is formed from water having high concentrations of polyvalent ions, and may comprise one or more of calcium salts, barium salts, magnesium salts, etc., such as the carbonate, sulfate, oxalate, silicate, etc. The scale deposits lead to plugging, pumping difficulties, loss of heat transfer, etc. Similar problems occur in cooling water systems and the removal of the scale is necessary to insure efficient operation. In another application, acid solutions are used to clean metal surfaces including, for example, in acid pickling systems. Regardless of the particular acid treatment, it is important to protect the metal from excessive loss of metal or other impairment thereof.

The acid treatment is effected in conventional manner using any suitable acid, including hydrochloric, sulfuric, phosphoric, etc. These acid treatments are well known in the industry and accordingly need not be described in detail herein. The inhibitor composition is incorporated in the acid solution in any suitable manner.

The following examples are set forth to illustrate the novelty of the compositions of matter of the present invention and their ability to act in a synergistic fashion. However, these examples are given merely for purposes of illustration and are not intended to limit the generally broad scope of the present invention in strict accordance therewith.

EXAMPLE I

In this example a series of evaluations were made in which inhibitors were admixed with 460 grams of 15° Baume commercial muriatic (hydrochloric) acid and the mixture was diluted to 10% with distilled water. The tests were run on zinc strips of equal dimensions and an approximate equal weight of 2 grams. In the tests the zinc strips were immersed in the acid solution for a period of 3 hours at a temperature of 70° F. and the results were compared. The N,N'-dicyclohexyl-thiourea which was used in this example comprises a commercial product which is available under the trade name (Main 33S) and is believed to comprise about 16% by weight N,N'-dicyclohexyl-thiourea, about 60% by weight of N,N-dimethylacetamide and about 30% by weight of a polyoxyethylene or polyoxypropylene derivative having a molecular weight of about 800. In addition, the other inhibitor which was tested alone or in combination with the dicyclohexyl-thiourea to illustrate the novelty and synergistic effect of the present invention comprised ethynyl cyclohexanol. In the tests as set forth below 2 grams of a mixture was added to the 460 grams of muriatic acid. The results of the six tests are set forth in Table I below:

TABLE I

| Test No. | Inhibitor | Time-Minutes | Weight Loss % |
|---|---|---|---|
| 1 | None | 140 | 100 |
| 2 | 2 gms DCT* | 180 | 5.6 |
| 3 | 2 gms ECH** | 180 | 80.8 |
| 4 | 1 gm DCT<br>1 gm ECH | 180 | 0.1 |
| 5 | 1.33 gm DCT<br>0.67 gm ECH | 180 | 9.8 |
| 6 | 0.67 gm DCT<br>1.33 gm ECH | 180 | 1.3 |

*N,N'-dicyclohexyl-thiourea
**Ethynyl cyclohexanol

It is therefore readily apparent from the above table that when no inhibitor was present in the acid solution the zinc strip was completely destroyed. In contradistinction to this, the individual acid solutions containing N,N'-dicyclohexyl-thiourea or ethynyl cyclohexanol exhibited some protection of the metal to a varying degree. However, it will be seen in Test No. 4 and Test No. 6 that a considerable reduction in weight loss was obtained when using these mixtures in a ratio of from about 70 to about 50% by weight ethynyl cyclohexanol and from about 50 to about 30% by weight of N,N'-dicyclohexyl-thiourea, the optimum results in weight loss reduction being obtained when using the two components of the mixture in equal amounts.

EXAMPLE II

In this example another test was performed in substantially the same manner as that set forth in Example I above. However, the metal which was used in this test consisted of mild steel strips of equal dimensions and approximately equal weight of 11 grams. Each strip was immersed in the acid solution for 24 hours at a temperature of 65° C. The acid solutions which were used in this example consisted of a 20% distilled water solution of 15° Baume commercial muriatic acid with the inhibitors being added in the amounts shown in the table below in 460 grams of the acid. The results of these tests are shown in Table II below:

TABLE II

| Test No. | Inhibitor | Weight Loss % |
|---|---|---|
| 1 | None | 67.0 |
| 2 | 2 gm DCT | 3.5 |
| 3 | 2 gm ECH | 2.1 |
| 4 | 1 gm DCT<br>1 gm ECH | 0.7 |

Again it is shown from the above table that by utilizing a combination of equal amounts of N,N'-dicyclohexyl-thiourea and ethynyl cyclohexanol that a synergistic effect is obtained whereby the weight loss of the metal is reduced to a greater extent that is obtained when using each of the inhibiting compounds alone.

EXAMPLE III

In like manner when equal amounts of N,N'-dicyclohexyl-thiourea and propynyl cyclohexanol and equal amounts of N,N'-dicyclohexyl-thiourea and ethynyl cyclopentanol are mixed and used as corrosion inhibitors, it will be found that the aforesaid mixture will exhibit a synergistic effect with relation to the weight loss of zinc strips or mild steel strips as compared to the weight loss which is exhibited when said strips are treated with a muriatic acid solution which does not contain either of said mixtures or where the muriatic acid solution contains only one of the aforesaid components of the mixtures.

I claim as my invention:

1. A synergistic mixture of from about 50% to about 70% by weight of ethynyl cyclohexanol and from about 50% to about 30% by weight of N,N'-dicyclohexyl-thiourea.

2. The method of removing scale from a metal surface in a boiler used to generate steam from water which comprises treating said surface with an acid solution containing from about 0.1 to about 1,000 parts per million of the synergistic mixture of claim 1.

3. The method of cleaning a metal surface by treatment with an acid solution which comprises adding to the acid solution from about 0.1 to about 1,000 parts per million of the synergistic mixture of claim 1.

4. In the acid pickling of metal, the improvement which comprises adding to the acid solution from about 0.1 to about 1,000 parts per million of the synergistic mixture of claim 1.

* * * * *